US008864272B2

(12) United States Patent
Claramunt et al.

(10) Patent No.: US 8,864,272 B2
(45) Date of Patent: Oct. 21, 2014

(54) TENSION MODULE FOR WIDE FORMAT INKJET PRINTERS

(75) Inventors: David Claramunt, Sant Esteve Sesrovires (ES); Jose Antonio Alvarez, Barcelona (ES); Raimon Castells, Barcelona (ES); Francisco-Javier Perez, Barcelona (ES); Laura Sanchez-Domingo, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/701,296

(22) PCT Filed: Jun. 2, 2010

(86) PCT No.: PCT/US2010/037125

§ 371 (c)(1), (2), (4) Date: Nov. 30, 2012

(87) PCT Pub. No.: WO2011/152825

PCT Pub. Date: Dec. 8, 2011

(65) Prior Publication Data

US 2013/0135415 A1 May 30, 2013

(51) Int. Cl.

| | |
|---|---|
| ***B41J 29/38*** | (2006.01) |
| ***B41J 15/16*** | (2006.01) |
| ***B41J 11/00*** | (2006.01) |
| ***B65H 20/02*** | (2006.01) |

(52) U.S. Cl.

CPC ..... *B41J 15/16* (2013.01); *B65H 2404/531* (2013.01); *B65H 2801/12* (2013.01); *B41J 11/001* (2013.01); *B65H 2511/224* (2013.01); *B65H 20/02* (2013.01); *B65H 2511/22* (2013.01)

USPC ..... 347/16; 347/104

(58) Field of Classification Search

CPC ..... B41J 11/42

See application file for complete search history.

(56) References Cited

U.S. PATENT DOCUMENTS

| | | | | |
|---|---|---|---|---|
| 4,680,696 | A | 7/1987 | Ebinuma et al. | |
| 5,450,102 | A | 9/1995 | Ishida et al. | |
| 5,674,019 | A * | 10/1997 | Munakata et al. | 400/568 |
| 6,568,320 | B2 | 5/2003 | Wada et al. | |

(Continued)

FOREIGN PATENT DOCUMENTS

| | | |
|---|---|---|
| JP | 07-025097 | 1/1995 |
| JP | 2003170633 A | 6/2003 |

(Continued)

OTHER PUBLICATIONS

Hewlett-Packard Development Company, L.P., International Search Report and Written Opinion dated Mar. 30, 2011, PCT App. No. PCT/US2010/037125, filed Jun. 2, 2010, 13 p.

*Primary Examiner* — Justin Seo

(57) ABSTRACT

Systems and methods for wide format ink printing are described. In one embodiment, a tension module for wide format inkjet printers is described which includes a throughput roller comprising a material having a length to diameter ratio of at least 10:1 and a friction coefficient value less than 1. The tension module further includes a plurality of pinch rollers adjacent to and supporting the throughput roller, and a motor operable to rotate the throughput roller. The plurality of pinch rollers and the rotation of the throughput roller in combination are operable to draw the print medium between the plurality of pinch rollers and the throughput roller.

11 Claims, 3 Drawing Sheets

(56) References Cited

U.S. PATENT DOCUMENTS

| | | | | |
|---|---|---|---|---|
| 6,641,314 | B2 | 11/2003 | Mogi | |
| 7,416,127 | B2 | 8/2008 | Page | |
| 2003/0048345 | A1* | 3/2003 | Matsumoto | 347/104 |
| 2003/0223794 | A1* | 12/2003 | Shirota et al. | 400/55 |
| 2004/0189773 | A1* | 9/2004 | Masumi et al. | 347/102 |
| 2005/0083392 | A1 | 4/2005 | Silverbrook | |
| 2006/0067757 | A1* | 3/2006 | Anderson et al. | 399/341 |
| 2006/0115288 | A1* | 6/2006 | Roof | 399/67 |
| 2007/0063429 | A1 | 3/2007 | Kang | |
| 2007/0065216 | A1* | 3/2007 | Hamaba et al. | 400/619 |
| 2008/0181707 | A1* | 7/2008 | Martin et al. | 400/579 |
| 2011/0265674 | A1* | 11/2011 | Dim et al. | 101/475 |
| 2011/0279518 | A1* | 11/2011 | Love et al. | 347/22 |

FOREIGN PATENT DOCUMENTS

| | | | |
|---|---|---|---|
| WO | WO-2007030854 | A1 | 3/2007 |
| WO | WO-2008093157 | A1 | 8/2008 |
| WO | WO-2011152825 | A1 | 12/2011 |

* cited by examiner

TENSION MODULE FOR WIDE FORMAT INKJET PRINTERS

CROSS-REFERENCE TO RELATED APPLICATION

The present application is the U.S. National Stage under 35 U.S.C. §371 of International Patent Application No. PCT/US2010/037125, filed 2 Jun. 2010, the disclosure of which is hereby incorporated herein by reference.

BACKGROUND

Until recently, many inks used for signage, billboards, and other large display media printed with wide-format printers were solvent-based inks. More specifically, most of these display media are made of vinyl and the use of solvent-based inks helps the pigments contained therein bind with the vinyl. This binding makes a printed outdoor display durable enough to withstand both rain and other types of storms. However, print service providers are looking for alternatives to solvent-based inks due to health concerns and environmental issues that can arise from the use of these inks. One alternative is the use of water-based latex inks.

Latex-based ink includes latex polymer and pigment particles, and comprises of up to 70 wt % or more of water. Latex inks are also typically odorless and do not release toxic fumes. Some challenges with wide-format printers, including latex ink wide-format printers, include preventing capillary action, e.g., the wet ink being drawn into the surrounding dry media, where edges of the printed characters tend to become less defined or where different colored inks bleed into one another. Also, print media typically used in wide-format printers are wide and/or long enough so as to render them delicate for use. As a result, this type of print media is susceptible to wrinkles and misalignment.

DETAILED DESCRIPTION

Figure 1A:
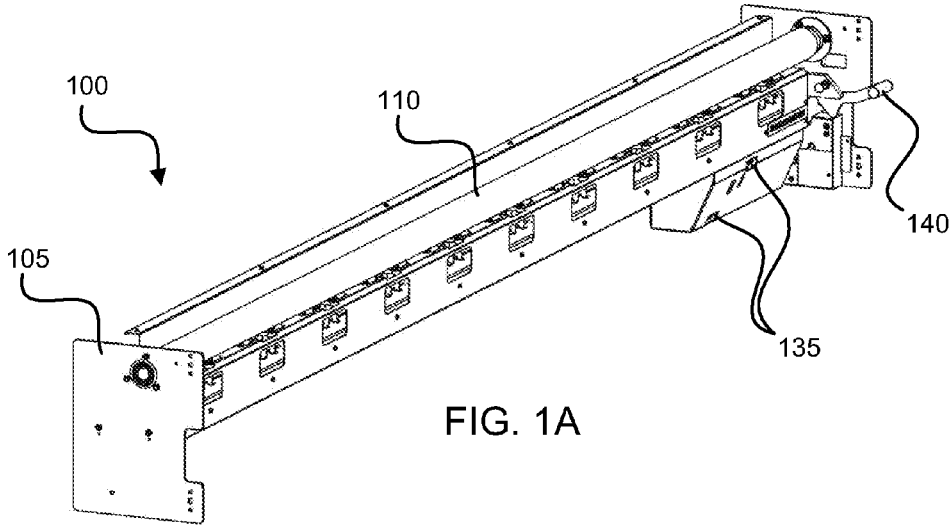
FIG. 1A is a front left perspective view of a tension module in accordance with examples of the present disclosure.

Reference will now be made to the examples illustrated herein, and specific language will be used herein to describe the same. It will nevertheless be understood that no limitation of the scope of the technology is thereby intended. Additional features and advantages of the technology will be apparent from the detailed description which follows, taken in conjunction with the accompanying drawings, which together illustrate, by way of example, features of the disclosure.

In accordance with an embodiment of the present disclosure, a tension module for a wide format inkjet printer can comprise a throughput roller, a plurality of pinch rollers, and a motor. The throughput roller is adapted for a wide format inkjet printer having a length to diameter ratio of at least 10:1 and comprising a material on the surface thereof. The material has a friction coefficient value less than 1, e.g., from 0.6 to 0.8 in one example. The plurality of pinch rollers are arranged in a line parallel to a long axis of the throughput roller, and also support the throughput roller along the length thereof. The pinch rollers also provide pressure on a print medium when passed along the throughput roller. The motor is operable to rotate the throughput roller, wherein the plurality of pinch rollers and the rotation of the throughput roller in combination draw the print medium between the plurality of pinch rollers and the throughput roller. In one specific embodiment, the tension module further comprises a sensor or a plurality of sensors operable to sense advancement of the print medium past the plurality of sensors, the sensor(s) being positioned to read and adapted to transmit a drive signal in response to the advancement of the print medium.

In another embodiment, a wide format inkjet printer comprise the tension module described generally above, an input roller operable to feed a print medium to the throughput roller and plurality of pinch rollers of the tension module, and an inkjet print head positioned for printing ink onto the print medium between the input roller and the tension module. A take-up roller can optionally be present providing a roll-to-roll printing functionality. Alternatively, the printing system can be adapted for roll-to-floor printing functionality (whether a take-up roller is present or not).

In another embodiment, a method of printing on wide format media comprises steps of receiving a print medium at an input roller; holding the print medium against a platen using vacuum suction while printing inkjet ink from an inkjet print head onto the print medium; and receiving the print medium between a throughput roller and a plurality of pinch rollers adjacent to and supporting the throughput roller. The throughput roller has a coefficient of friction value less than 1 and a length to diameter ratio of at least 10:1. Typically, the surface of the pinch rollers is of a non-rubber material. Additional steps include applying a pressure on the print medium using the throughput roller and the plurality of non-rubber pinch rollers to maintain a tension on the print medium between the input roller and the throughput roller; and rotating the input roller and the throughput roller substantially synchronously to maintain the tension to output the print medium.

With these general embodiments set forth above, it is noted that when describing the tension model, the inkjet printer, or the related method, each of these descriptions are considered applicable to the other, whether or not they are explicitly discussed in the context of that embodiment. For example, in discussing the printer, the tension module and/or method embodiments are also included in such discussions, and vice versa.

Also, it is noted that various modifications and combinations can be derived from the present disclosure and illustrations, and as such, the following figures should not be considered limiting. Thus, when describing specific embodiments or examples in detail, such description, no matter how much detail is present, should not be considered limiting.

Thus, in more specific detail, systems and methods for wide format inkjet printing are described which can reduce cost, size, and waste, while increasing productivity and allowing printing of a variety of media types, including non-stiff print media, and particularly, large format media. As used in this document, "large format" means at least at least 36 inches wide.

Figure 1B:
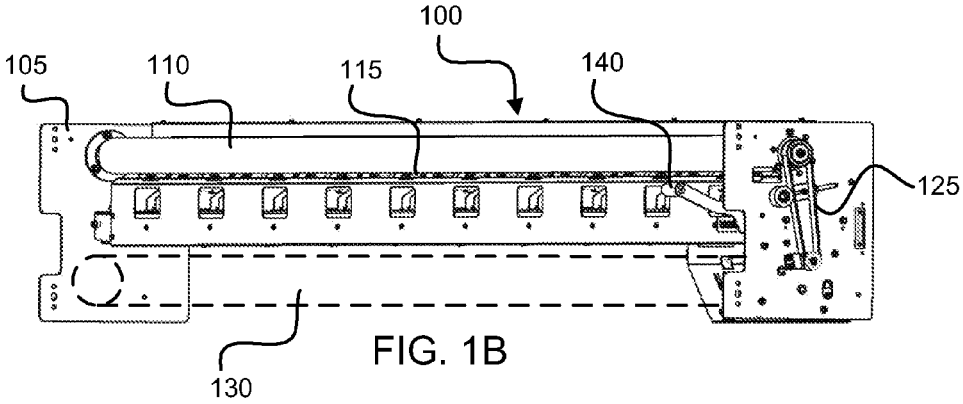
FIG. 1B is a front, angled right perspective view of the tension module of FIG. 1A.
Figure 1C:
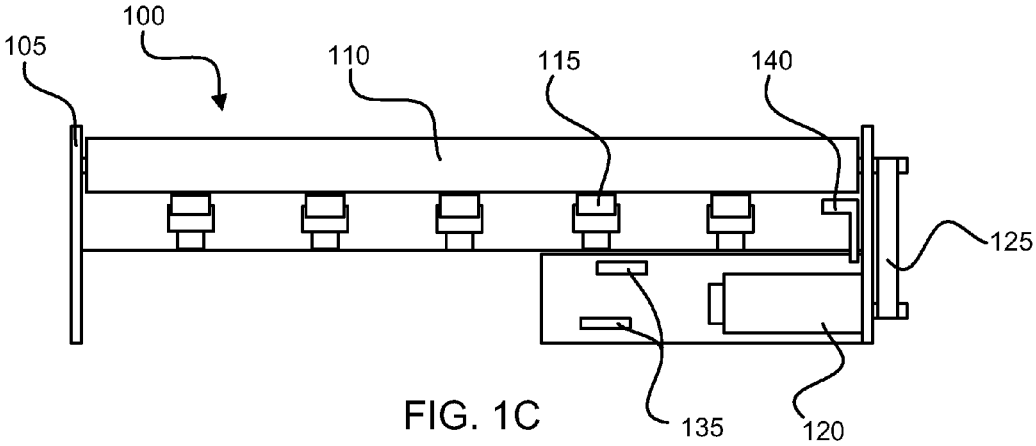
FIG. 1C is a simplified schematic front view of a tension module similar to that shown in FIG. 1A.

In an example system shown in FIGS. 1A-1C, a tension module 100 for wide format inkjet printers is shown and described. FIGS. 1A-1B set forth a detailed drawing of a tension module in accordance with an embodiment of the present disclosure, whereas FIG. 1C sets forth a simplified drawing of a similar tension module. FIG. 1C is not drawn to scale and is merely included to provide additional clarity to the FIGS. with respect to major components of the systems and methods of the present disclosure. That being stated, none of these embodiments should be considered limiting. Turning now to FIGS. 1A-1C, the tension module includes a frame 105, a throughput roller 110, pinch rollers 115, and a motor 120. The throughput roller is attached to the frame and receives and feeds a print medium (not shown). The throughput roller includes a rubber material having a low friction coefficient value, e.g. from 0.6 to 0.8, for example. The pinch rollers are attached to the frame and adjacent to the throughput roller. The motor is attached to the frame and operable to rotate the throughput roller. The pinch rollers and the throughput roller in combination use friction to draw the print medium between the pinch rollers and the throughput roller while maintaining a tension on the print medium. In one embodiment, the tension module maintains the tension between the throughput roller and an input roller that exists on the underlying printer apparatus (not shown) to which the tension module is attached.

As shown, the throughput roller 110 is attached to a frame 105 of the module 100 and is configured for receiving and feeding a print medium. In one embodiment, the throughput roller is slender and light compared with typical nip rollers. For example, typical nip rollers have a diameter of 200 mm or more. In contrast, the throughput roller in this embodiment has a diameter much smaller, e.g., less than 100 mm or less than 75 mm. Furthermore, since this module is used for wide format printing, a length of at least 36 inches provides a length to diameter ratio which may cause the throughput roller to be prone to deflection or bending. Specifically, weight deflection of the smaller diameter throughput roller that may otherwise cause wrinkles in non-elastic media if loaded on one side of the printer, e.g., print media not centered, is compensated for by pinch rollers, described below, that exert a force against the throughput roller, causing the throughput roller to be straight during printer operation, regardless of the relative position of the print media on the throughput roller.

As also described above, wide-format printers can have issues with ink smearing, patterning, wrinkles, and so forth. The nip rollers for the printers are created with substantial weight and diameter to minimize the effects of the aforementioned issues. A large diameter roller in previous printers is used to reduce sag or bending towards the center of the roller which results from gravity and the weight of the roller. The purpose of the heavier weight of the nip roller firmly holds the print media in place. However, the throughput roller of the present disclosure, though lighter and more slender than previous nip rollers, is capable of producing a high quality print product without patterning, wrinkles, and so forth, when used with the other components of the tension module as described herein.

In one embodiment, the throughput roller 110 comprises a hard rubber exterior. In one embodiment, beneath the rubber is a metal, or preferably steel, substrate. The thickness of the hard rubber exterior coating over the metal interior is relatively thin compared to the total diameter of the throughput roller. The hard rubber coating in some examples is less than 5 mm thick, and less than 2.5 mm thick in other examples. As mentioned, the hard rubber coating has a low friction coefficient value. The coefficient of friction value is determined at a value sufficient to hold a tension on the print medium but low enough to prevent wrinkles in non-elastic print media, such as vinyl, without causing slippage marks in sensitive media, such as backlit media. The pinch system also enables a lower pinch force to hold the print medium without risk of damage to a more delicate media, such as textiles.

Specifically, the rubber exterior of the throughput roller 110 has a low coefficient of friction which provides high quality printing results on a variety of media types, including non-elastic, delicate, and so forth. Typically, the coefficient of friction is less than 1. In some examples, the coefficient of friction value is from 0.6 to 0.8. In more specific examples, the coefficient of friction value is about 0.7. The friction coefficient is selected to allow some local media slippage at the throughput roller to enable correction of media misalignments. Media misalignments often result from defective input media rolls or improper loading of the media by a user.

A throughput roller 110 with a friction coefficient as described above can avoid over-constraint of media, e.g., causing wrinkles, without using very stiff and precisely parallel nip rollers. The throughput roller is used in combination with a plurality of pinch rollers 115 also attached to the module frame 105. The pinch rollers are adjacent to the throughput roller. The pinch rollers can be actuated to press the print medium against the throughput roller, which can be in a fixed position. The pinch rollers can also be de-actuated so as to separate from the throughput roller to allow media loading and unloading. The pinch rollers provide an opposing force to pressure on the print medium exerted by the throughput roller. In other words, pressure is exerted on the print medium by the force of the throughput roller pressing against opposing pinch rollers. The pinch rollers comprise a smaller diameter than the throughput roller. In some examples, the pinch rollers comprise a diameter less than half of the diameter of the throughput roller. In other examples, the pinch rollers comprise a diameter less than one-third of the diameter of the throughput roller. For instance, the pinch rollers in one example comprise an 18 mm diameter cylinder. Furthermore, the throughput roller comprises a single elongate roller extending along a width of the print platen and the pinch rollers comprise multiple shorter rollers spaced along the width of the print platen, opposite the throughput roller. The throughput roller and pinch rollers are configured to receive the print medium therebetween for receiving the print medium. The throughput roller and pinch rollers are located on an output side of the wide-format printer.

In one specific example, the tension module comprises 20 pinch rollers arranged and extending along a length of the single throughput roller. In the example shown in FIGS. 1A-1C, the tension module comprises 10 pinch rollers arranged and extending along a length of the single throughput roller. The pinch rollers typically are made from a non-rubber material, such as plastic.

A motor 120 is attached to the module frame 105 and is operable to rotate the throughput roller 110. Regarding the motor in this embodiment, a belt 125 is present which extends from the motor to the throughput roller to cause the throughput roller to rotate when the motor is operated. Also, as described above, the pinch rollers 115 and the throughput roller in combination are operable to use friction to draw the print medium between the pinch rollers and the throughput roller while maintaining a tension on the print medium between the throughput roller and the input roller. However, the friction against the throughput roller is not so high that the print media cannot be adjusted or self correct as a result of misalignment or other minor feed malfunctions.

The tension module 100 optionally includes a take-up roller 130. That being stated, in one more typical example, the take-up roller is provided by a printer associated with the tension module and is not included as a part of the tension module. The take-up roller is configured to receive the print media after the print media is drawn between the plurality of pinch rollers 115 and the throughput roller 110. The take-up roller is operable, as the name suggests, to take-up, or roll, the printed media after passing the throughput roller. In this example, the printer operates in a roll-to-roll configuration. In other words, the print medium is input from a roll and is output to a roll.

The take-up roller 130 is operable to maintain a lesser tension on the print medium between the throughput roller 110 and the take-up roller than a tension on the print media between the throughput roller and the input roller. During printing, the ink is not yet dried or cured and is susceptible to smearing, bleeding, and so forth. Furthermore, the wet ink increases the chances of wrinkles, patterning, and so forth. Thus, a predetermined tension can be maintained between the input roller and the throughput roller during printing, drying, and curing of the inks. However, after the ink is printed, dried, and/or cured, the aforementioned dangers to the ink and/or print medium are reduced. Therefore, the tension from the throughput roller does not need to be as great as the tension between the input roller on the main body of the printer and the throughput roller on the tension module. As will be described below, the printer, including the tension module, is operable in a roll-to-floor or roll-to-freefall configuration as well as the roll-to-roll configuration. The tension in the roll-to-floor configuration comprises only tension caused by gravity and the weight of the print medium past the throughput roller. Also, the weight of a light tube, called a "loop shaper" used in take-up reels can maintain a proper loop shape while avoiding wrinkles that otherwise may be wound into the take-up reel.

The tension module 100 is configurable either as an integral part of a printer device or as an add-on module to add additional functionality to a wide-format printer. Where the tension module comprises an add-on module, a set of relays is used to commute the power from the previous printer output roll motor to the new throughput roller motor. In roll-to-roll wide-format printers, the output and input rollers each comprise a motor configured to respectively rotate the large output and input rollers to move the print medium while maintaining the tension. Adding a new output motor 120 for a new throughput roller 110, instead of using a clutch on an existing motor, enables use of the previous output roll motor and throughput roller shaft as a take-up reel or take-up roller. This configuration enables winding the print medium in a roll that is easily removable from the printer after cutting the printing media for finishing while printer keeps printing free-fall.

This design allows use of existing printer architecture without any modification (when the tension module comprises an add-on modular accessory). The media path and the media management methods are the same as those in the pre-modified roll-to-roll printer configuration. Thus, the module adds roll-to-freefall and take-up-reel features to enhance the user experience and expand printing possibilities with low impact to the previous printer design.

The tension device 100 further comprises a plurality of optical sensors 135 integrally formed with the tension module. The sensors are operable to sense advancement of the print medium past sensors. The sensors are configured to transmit a drive signal to in response to the advancement of the print medium. A take-up roller driver is configured to receive the drive signal from the sensors and to rotate the take-up roller 130 (either on the tension module itself, or elsewhere on the associated printer) to maintain the lesser tension. In an example, the plurality of optical sensors comprises two optical sensors and a small printed circuit assembly (PCA) mounted on a support to provide the take up reel functionality. The sensors are reflective infrared sensors that detect the presence of a media loop coming from the throughput roller and trigger the movement of the take-up-roller motor, e.g., the old throughput roller motor in a retrofit printer, actuated by a low power driver. One sensor is placed above the other in this configuration so that the take-up reel will unwind if the print medium is moving backwards in the printer or will wind if the print medium is moving forwards in the printer. The PCA is used to obviate the need to make minor changes in the existing printer electronics and also to add a filter for the sensor signal to avoid electrical noise contaminations. The sensors are connected to the PCA and the PCA is connected to a previously existing port in the printer electronics, when the module is used as an add-on.

Use of the sensors 135 allows winding and unwinding of a roll-to-roll print medium or free-fall medium in a roll that is easily removable from the printer after cutting the printing media for finishing while the printer keeps printing free-fall. The printed portion after cutting is also rollable on the take-up-roller 130. The take-up-roller motor uses a low power driver which is available in the preconfigured printer electronics. A high power driver is also used for the new throughput roller motor 120.

In one example, the optical sensors 135 are operable to detect motion and direction of the print medium as follows. As described above, the take-up roller 130, which is part of the tension module per se or alternatively part of the associated printer, is configured to maintain a lesser tension on the print medium. The take-up roller maintains the lesser tension such that a loop is formed in the print medium. In other words, the print medium hangs between the throughput roller 110 and the take-up roller with a length of print medium between the throughput roller and the take-up roller greater than the actual distance between the throughput roller and the take-up roller such that a loop of hanging print media is formed. The sensors comprise a lower sensor and an upper sensor. The lower sensor is operable to sense the advancement of the print medium by sensing when the loop passes below the lower sensor. The upper sensor is likewise operable to sense reverse movement of the print medium by sensing when the loop passes above the upper sensor. The take-up roller driver is configured to receive the drive signal from the upper sensor and operable to rotate the take-up roller in a reverse direction when the loop passes above the upper sensor. The loop passing above the upper sensor is an indication that the print medium is being reversed through the printer. Likewise, the loop passing below the lower sensor is an indication that the print medium is being advanced and that the take-up roller ought to be rotated to maintain the proper loop size and/or print medium tension.

In a printer that uses high heating of the printing medium in the print zone to dry the ink and consequently high vacuum to control the wrinkles from expansion, a relatively high tension pulling on the media after being printed is used to allow media to advance on the print area, as the media cannot "fall free" just by being pushed from behind with the input printer roller located previous to the print zone. For instance some wide-format printers use ecological latex inks in which high drying and curing temperatures are used. Previous printers wind the media in an output roll (after unwinding from the input roll, printing at the print platen, then drying and curing the ink), which involved a great deal of expensive media waste. Heavy media rolls are kept at low height to facilitate easy loading while the print zone is at user height for convenience in viewing and retrieving printed print medium and operating the printer. When new, unprinted media rolls are loaded into the printer, unprinted media is advanced past the printing zone to be attached to the output shaft. This extra media cannot be used for printing because the extra media is used to attach to the output shaft to maintain the proper printing tension. As an alternative, "sacrificial" and inexpensive sheets of media have sometimes been used, but use of these sacrificial media sheets increases the risk of misalignments, skew, and wrinkles in the regular print media. Furthermore, configuration of the sacrificial media sheets is time consuming.

Performance of such a roll-to-roll printer is improved by using the tension module described herein. The tension module is able to reduce media waste because the print media need only extend to the throughput roller which is placed closer to the print platen than the previous throughput roller. For example, the throughput roller is placed at the user height rather than the floor, which also reduces a media load time. Additionally, an unload time of the print media is reduced since the print media can be printed roll-to-floor instead of roll-to-roll. Furthermore, the tension module enables immediate availability of printed plots without stopping as the printer continues printing the input roll simply by cutting printed plots past the device pinch rollers. Also, the take-up-roller provide quick and easy unloading of short printing runs in a manageable roll without having to stop printing (because the tension device keeps working). Thus, printer and user productivity is increased.

The tension module and printing systems and methods described herein are designed for use in wide-format printers using heat and vacuum to print, dry, and cure the ink. The tension module and printing systems and methods are well-suited for using in wide-format printers using latex inks dried with radiant heat and airflow. Print zone and curing zone heaters comprise radiant heating elements. An infrared (IR) temperature sensor measures the surface temperature of the print medium in each zone, and media guards prevent contact between the heating elements and the print media as the print media passes through printing and curing zones. When heating and/or curing, in one embodiment, forced airflow carries evaporated ink components out of the print zone, through the curing zone, and exhausts at the front of the printer. An array of small fans on the front of the printer mix ambient air with the exhaust to cool the print and to reduce vapor condensation. The temperatures in the two zones are individually adjustable and presets are provided for common media types and substrates. Print zone temperatures may be set between 40° C. and 65° C., while curing zone temperatures may be set between 60° C. and 120° C.

Continuing with FIGS. 1A-1C, in another embodiment, a variable tension printer is used to provide a tension on the print medium suited for the particular print medium. Thus, the tension module 100, according to an example, comprises a tension lever 140. The tension lever comprises a plurality of tension settings and is operable to adjust a pressure between the throughput roller and the pinch rollers to adjust the tension on the print medium. In other words, the tension lever is configured to vary a pinch force of the throughput roller against the pinch rollers. The tension lever comprises a plurality of stops for setting the pressure. While in previous printers slippage of print media is prevented via roll-to-roll configurations, large heavy nip-rollers, high tension, and so forth, the tension lever of the present technology enables tension settings which allow some media slippage. The proper rubber coefficient of friction, as described, is set to enable sufficient grip of the print media, based on the pressure applied (as determined by the tension lever), while still allowing some slippage of the media to prevent wrinkles without causing slippage marks, particularly on delicate print media. In one example, the tension lever comprises two tension settings. A first tension setting is provided where the pressure applied to the print medium causes a distributed load smaller than a weight of the throughput roller. In other words, the first tension setting is a low force setting. A second tension setting is provided where a distributed pinch load is applied to the print medium which is the same as the weight of the throughput roller and is caused by pressing the throughput roller more firmly against the pinch rollers.

Figure 2:
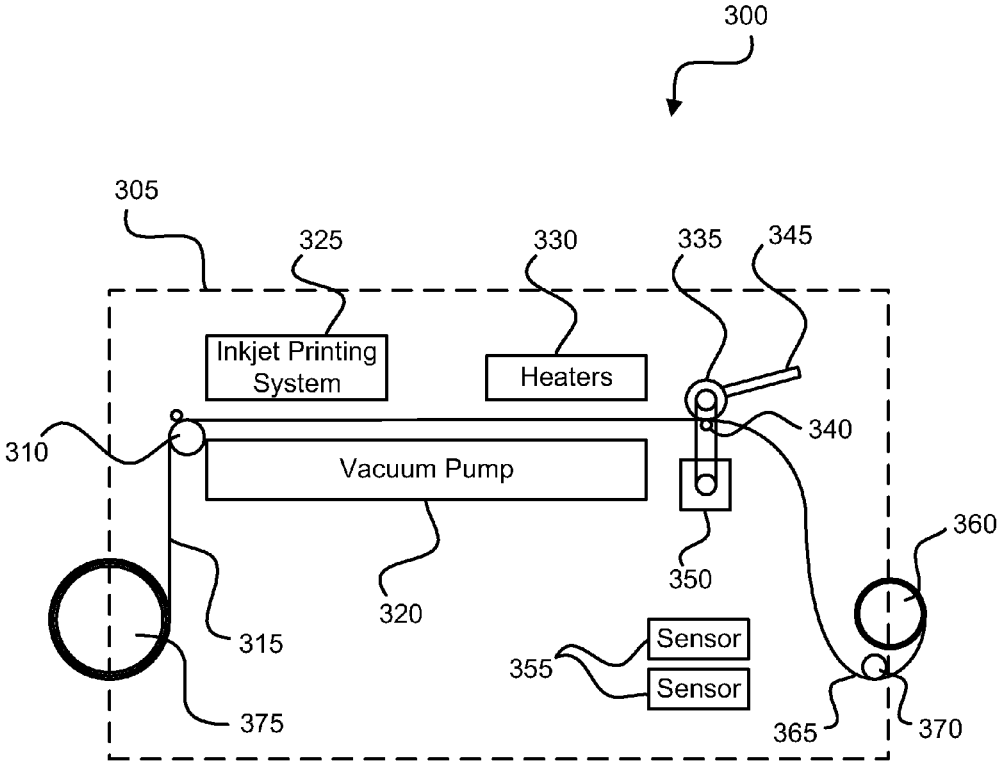
FIG. 2 is a block diagram of a wide-format inkjet printer in accordance with examples of the present disclosure.

Referring to FIG. 2, a block schematic diagram of a wide format inkjet printer 300 is shown. The printer includes a frame 305 and an input roller 310 attached to the frame. The input roller is operable to receive (from a supply roll 375 or otherwise) and securely hold a print medium 315. An inkjet print printing device 325, including inkjet nozzles and an ink tank containing ink (such as latex ink or the like), is also present. One or more inkjet printing device is configured to apply the ink to the print substrate after the print substrate has passed the input roller and according to a predetermined pattern to produce an image on the print substrate. A vacuum pump 320 is configured to hold the print substrate against a print platen for printing. A plurality of heaters 330 are operable to dry and/or cure the ink on the print substrate, depending on the embodiment.

A throughput roller 335 as described herein is attached to the frame 305. Specifically, the throughput roller comprises a rubber skin of low coefficient of friction value and is operable to apply pressure to the print substrate 315. The pressure enables maintenance of a first tension on the print substrate between the input roller 310 and the throughput roller. This pressure is applied by pressing the plurality of pinch rollers 340 against the throughput roller. The pinch rollers are substantially adjacent to the throughput roller and are distributed along a length of the throughput roller. In one example, the pinch rollers are evenly spaced along the length of the throughput roller. The pinch rollers are assembled on a single support sheet metal beam below the throughput roller to compensate for weight deflection of the throughput roller in one embodiment. As noted above, weight deflection is a potential cause of wrinkles, particularly in non-elastic print media loaded at one side of the printer, e.g., media is not centered with a printer centerline. The print media being loaded at one side of the printer is common in inkjet printers to avoid ink crusting in the print heads, due to printing in an area away from the print head servicing station on a side of the printer.

A rubber roller motor 350 is attached to the frame and is operable to rotate the throughput roller. The rubber roller motor includes a belt transmission system to drive the hard rubber roller. In examples where the printer is a new printer configured with the tension module described herein, the rubber roller motor is configured to directly drive the throughput roller without a belt transmission system. A belt transmission system is useful in positioning the motor in the room available in the printer in a retrofit installation.

A take-up roller 360 (which in this embodiment is not part of the tension module) receives the print substrate 315 after the print substrate is drawn between the pinch rollers 340 and the throughput roller 335. A take-up roller motor is attached to the frame and is operable to rotate the take-up roller to roll the print substrate around the take-up roller. In a retrofit printer, e.g., a printer retrofitted with a tension module as described herein, the take-up roller motor comprises the previous throughput roller motor. A loop shaper 370 can be included to keep a desired loop shape to avoid wrinkles as the print medium is rolled onto the take-up roller.

Sensors 355 sense forward or reverse advancement of the print substrate past the sensors, which in turn transmit a drive signal the take-up roller motor to in response to the advancement of the print substrate. In one example, the sensors are operable by sensing whether a substrate loop 365 between the throughput roller and the take-up roller is below or above an upper or lower sensor, as has been described herein. The ability to sense reverse advancement and rotate the take-up roller in reverse enables a user to better conserve expensive print media. For example, the print substrate advancement is reversible through the machine to draw the last printed portion of the substrate closer to the throughput roller to minimize waste before cutting. Also, drawing the printed portion of the substrate closer to the throughput roller is useful to minimize unprinted substrate waste between subsequent print jobs on the same substrate.

A tension lever 345 includes a plurality of tension settings and is operable to adjust a pressure between the throughput roller 335 and the plurality of pinch rollers 340 to adjust the first tension. For example, the user is able to decide to use lower than nominal pinch force for a delicate media. In other example, where a bad media load has caused an initial wrinkle build-up of print media, pressure (and thus tension) is reduceable to eliminate continuance of the wrinkle build-up while printing and without having to release pinch rollers. Release of the pinch rollers would in turn affect line feed accuracy and potentially cause a media jam at the print zone. Experimental results demonstrate that an excessive pinch force level and/or friction cause wrinkle build up due to media overconstraint. In another example, the tension lever is operable to release tension on the print media such that no pressure is applied on the print media between the throughput roller and the pinch rollers. In this example, the print media is wrapped around the take-up roller and tension for printing on the print media is supplied by the rotation of the take-up roller in synchronization with the input roller.

The hard rubber-coated throughput roller 335 is configured to contact the printed side of the print medium. The friction coefficient of the rubber on the throughput roller is configured to allow some slippage in wrinkle-able print media and also to not cause marks in mark-able media. The low friction between the print media and rubber allows the media to move under tension and realign to avoid wrinkling from misalignments in the media load by the user and/or minor lack of parallelism among the different printer rollers moving the media, e.g., due to deflection caused by heavy media rolls loaded on one side of the printer.

A set of four relays are actuated by the firmware of the printer when the user chooses a particular operation mode in a user interface on the printer. The relays are operable to commute the high power drive available either to the throughput roller motor or to the take-up roller motor. According to one embodiment, there is a low power driver that is connected to the motor not having a high power driver, so where the low power driver is connected to the take-up-roll motor the lower power driver is usable to wind the media coming out of the throughput roller.

The firmware of a new printer or a retrofit printer uses the same routines to move the throughput roller as a pre-retrofit process to move the previous throughput roller in the roll-to-roll configuration. A set of servo constants is selected when the user chooses the mode of operation, e.g., roll-to-roll or roll-to-floor.

The tension module described herein has the capability of significantly increasing the productivity of previously existing roll-to-roll printers. For example, the tension module enables print job removal while the printer continues to print. Introduction of an urgent print job into a workflow is enabled with minimum impact on the workflow. The module enables switching between roll-to-floor and roll-to-roll printing modes in examples where the user wishes to use roll-to-roll rather than roll-to-floor. Example situations well-suited for use of roll-to-roll printing include unattended printing of a roll or where the print media is delicate and the user wishes to avoid passing the already printed media by the pinch rollers.

The tension module or tension device described herein provides a small cross section and weight module that integrates easily into a printer. To illustrate by specific example, in a particular embodiment where the wide-format printer comprises a 3.2 m wide print area, the tension module is configured to use the previously existing mechanical datuming for the media output system, without any restructuring of the previous printer design. The mechanical datuming for positioning, rather than laser precision alignment, is sufficient to produce a good performance when used with the mechanical configuration and rubber friction coefficient as described herein. Parts are relatively slender but distributed pinch force compensates for throughput roller deflection due weight of the throughput roller. Furthermore, the tension module enables reuse of the previously existing media output systems as a take up reel with the addition of optical sensors (and firmware programming for the new functionality).

Figure 3:
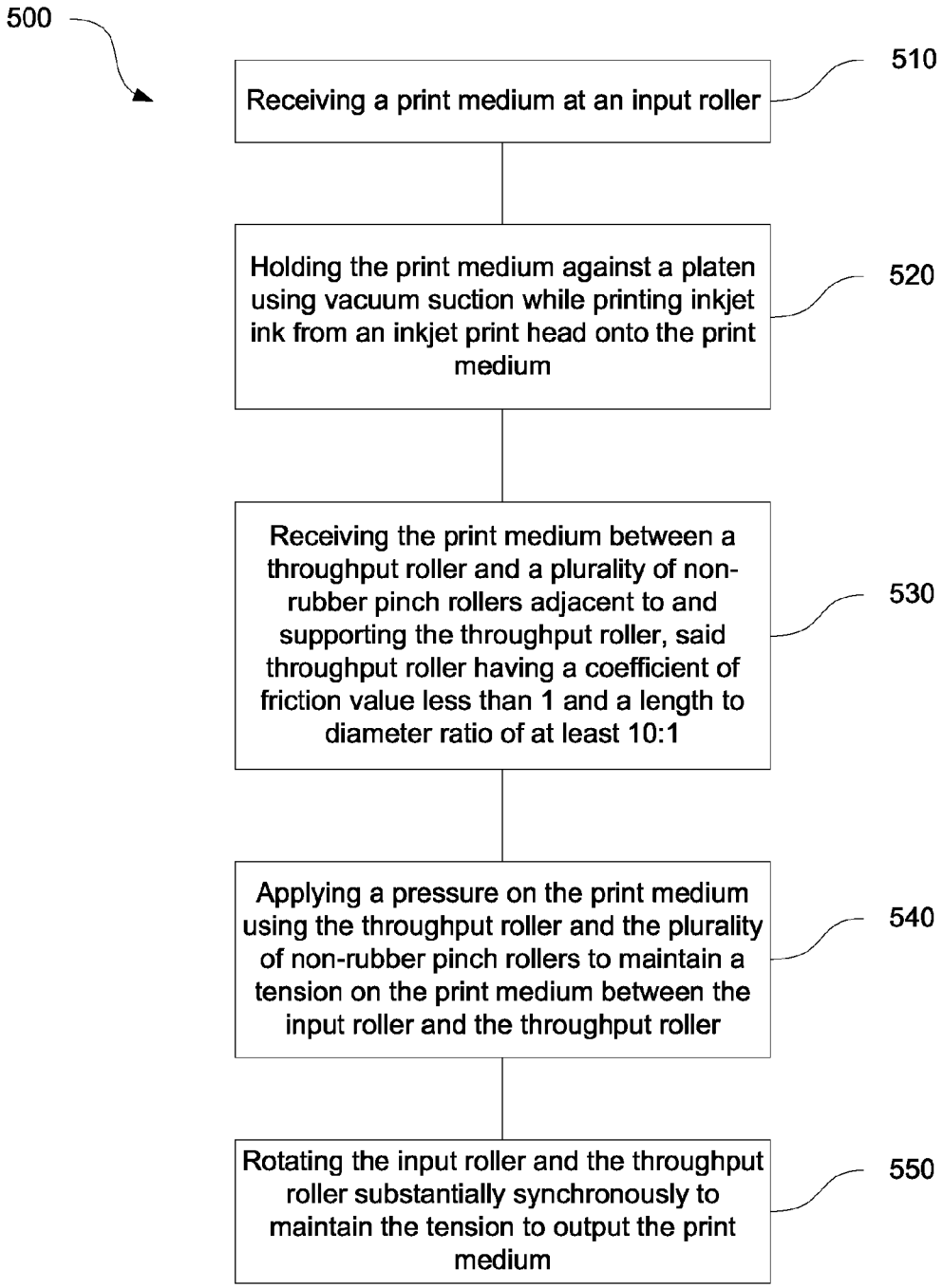
FIG. 3 is a flow diagram of a method for wide-format inkjet printing in accordance with examples of the present disclosure.

Referring to FIG. 3, a flow diagram of method 500 of printing using a wide format inkjet printer is shown. The method includes receiving 510 a print media at an input roller. Types of printable print media according to the method include a wide variety of print media. For example, the print media includes vinyl, banner media, film, fabric, paper, mesh, textile, high-density polyethylene (HDPE), polyvinyl chloride (PVC), Tyveko™, or other latex-ink matched specialty materials. In one embodiment, a first pressure is applied on the print media by the input roller. The first pressure secures an end of the print media by the input roller. In other words, as a second end of the print media is pulled away from the input roller, the input roll is configured to rotate sufficiently slowly that a tension is maintained on the print media. Therefore, the pressure represents a force securing the print media to the input roller to enable the tension.

In a further step, the print media is held 520 against a print platen using vacuum suction. A predetermined pattern is printed onto the print medium using a print head, typically while the print medium is secured using vacuum suction. The print head, according to an example, comprises one or more inkjet nozzles. Also, in one embodiment, the printed pattern is heated to evaporate liquid in ink used to print the pattern. If using a latex ink, the liquid evaporated primarily comprises water, and the dried ink is optionally be cured.

The method continues wherein the print media is received 530 between a throughput roller having a low coefficient of friction and non-rubber pinch rollers substantially adjacent to the throughput roller. The non-rubber pinch rollers typically comprise plastic, and further comprise a smaller diameter and shorter length than the throughput roller. Pressure is also applied 540 to the print medium by the throughput roller and the non-rubber pinch rollers. This pressure is useful in maintaining a tension on the print media between the input roller and the throughput roller.

Another step includes rotating 550 the input roller from the body of the printer and the throughput roller of tension module substantially synchronously to maintain the tension at a substantially constant tension. Furthermore, the rotation of the throughput roller, in connection with the pressure of the throughput roller against the pinch rollers, serves to output the print medium from the printer after printing is complete.

In a more specific aspect relating to the method, additional steps of sensing advancement of the output print media using sensors are carried out. In combination with sensing the advancement of the output print media, a take-up roller is rotated to roll the output print media onto the take-up roller when the output print media is advanced. In a further aspect, the take-up roller is rotated in a forward direction when a lower sensor senses forward advancement of the output print media. In yet another aspect, the take-up roller is rotated in a reverse direction when a lower sensor senses reverse advancement of the output print media.

A further step of the instant method includes adjusting the second pressure depending on a type of the print media. According to one example, the adjustment of the second pressure often corresponds to print media type, print zone temperature, and/or curing zone temperature. The adjustment of the pressure applied to the media is effected through manipulation of a tension lever. The tension lever is configured to adjust a force with which the throughput roller presses against the pinch rollers.

A further step of this method includes switching between roll-to-roll and roll-to-floor printing functionalities. The take-up roll is configured to receive printed media thereon, thus acting as the second or receiving roll in roll-to-roll functional printers. In roll-to-floor functionality, otherwise referred to as roll-to-freefall functionality, printed media is not received onto a roller after being output past the throughput roller. Rather, the printed media is allowed to fall to the floor or simply hang from the printer.

As described above, the tension module is configurable as either a pre-installed integral component of a wide-format printer or as an add-on or installable module to add additional functionality to an existing printer. For example, installing the tension module in a roll-to-roll printer results in a printer with enhanced capabilities, including roll-to-floor functionality. Therefore, according to one example, the method further comprises retrofitting a roll-to-roll wide format inkjet printer with roll-to-floor functionality by installing the tension module in the roll-to-roll wide format inkjet printer.

While the foregoing examples are illustrative of the principles of the present technology in one or more particular applications, it will be apparent to those of ordinary skill in the art that numerous modifications in form, usage and details of implementation can be made without the exercise of inventive faculty, and without departing from the principles and concepts of the technology. Accordingly, it is not intended that the technology be limited, except as by the claims set forth below.

What is claimed is:

1. A tension module for wide format inkjet printers, comprising:

a throughput roller adapted for a wide format inkjet printer, said throughput roller having a length to diameter ratio of at least 10:1 and comprising a material on the surface thereof having a friction coefficient value with a print medium of less than 1;

a plurality of pinch rollers arranged in a line parallel to the throughput roller, said plurality of pinch rollers to support the throughput roller and provide a pressure on the print medium when passed along the throughput roller;

a motor operable to rotate the throughput roller, wherein the plurality of pinch rollers and the rotation of the throughput roller in combination are operable to draw the print medium between the plurality of pinch rollers and the throughput roller;

a single tension lever having a plurality of tension settings and operable to adjust the pressure between the throughput roller and the plurality of pinch rollers on the print medium; and wherein the tension module comprises a standalone module installable into the wide format inkjet printer to retrofit a roll-to-roll wide format inkjet printer with roll-to-floor functionality.

2. The tension module of claim 1, further comprising a plurality of sensors operable to sense advancement of the print medium past the plurality of sensors, the plurality of sensors being configured to transmit a drive signal in response to the advancement of the print medium.

3. The tension module of claim 1, wherein the coefficient of friction is from 0.6 to 0.8.

4. The tension module of claim 1, wherein the material comprises a rubber material on the throughput roller and extends along an entire length of the print medium when printing and the throughput roller comprises a diameter of less than 100 mm.

5. The tension module of claim 1, wherein the plurality of pinch rollers are non-rubber pinch rollers.

6. A wide format inkjet printer, comprising:

a tension module comprising:

a throughput roller adapted for a wide format inkjet printer, said throughput roller having a length to diameter ratio of at least 10:1 and comprising a material on the surface thereof having a friction coefficient value with a print medium of less than 1;

a plurality of pinch rollers arranged in a line parallel to the throughput roller, said plurality of pinch rollers to support the throughput roller and provide a pressure on the print medium when passed along the throughput roller; and a motor operable to rotate the throughput roller, wherein the plurality of pinch rollers and the rotation of the throughput roller in combination are operable to draw the print medium between the plurality of pinch rollers and the throughput roller; and a single tension lever having a plurality of tension settings and operable to adjust the pressure between the throughput roller and the plurality of pinch rollers on the print medium;

an input roller from which the print medium is input to the wide format inkjet printer and configured to maintain a tension on the print medium between the input roller and the throughput roller and plurality of pinch rollers of the tension module;

an inkjet print head positioned for printing ink onto the print medium between the input roller and the tension module; and wherein the tension module comprises a standalone module installable into the wide format inkjet printer to retrofit a roll-to-roll wide format inkjet printer with roll-to-floor functionality.

7. The wide format inkjet printer of claim 6, further comprising:

a take-up roller to receive the print medium after the print medium is drawn between the plurality of pinch rollers and the throughput roller, the take-up roll further being operable to maintain a lesser tension on the print medium between the throughput roller and the take-up roller than the tension on the print medium between the throughput roller and the input roller; and a take-up roller driver to receive the drive signal from a plurality of sensors and operable to rotate the take-up roller to maintain the lesser tension.

8. The wide format inkjet printer of claim 6, further comprising a plurality of heaters operable to dry the ink on the print substrate.

9. A method of printing on wide format media, comprising:

receiving a print medium at an input roller;

holding the print medium against a platen using vacuum suction while printing inkjet ink from an inkjet print head onto the print medium;

receiving the print medium between a throughput roller and a plurality of non-rubber pinch rollers adjacent to and supporting the throughput roller, said throughput roller having a coefficient of friction value with a print medium of less than 1, and a length to diameter ratio of at least 10:1;

applying a pressure on the print medium using the throughput roller and the plurality of non-rubber pinch rollers to maintain a tension on the print medium between the input roller and the throughput roller;

rotating the input roller and the throughput roller substantially synchronously to maintain the tension to output the print medium;

adjusting the tension on the print medium by adjusting the pressure between the throughput roller and the plurality of non-rubber pinch rollers with a single tension lever;

wherein the throughput roller, the plurality of pinch rollers, and the tension lever are disposed within a tension module; and retrofitting a roll-to-roll wide format inkjet printer with roll-to-floor functionality by installing the tension module in the roll-to-roll wide format inkjet printer.

10. The method of claim 9, further comprising:

sensing advancement of the output print medium using a sensor or plurality of sensors; and rotating a take-up roller in a forward direction to roll the output print medium onto the take-up roller when the sensors sense the advancement of the output print medium.

11. The method of claim 10, further comprising rotating the take-up roller in a reverse direction when a sensor or plurality of sensors senses reverse advancement of the output print medium.

* * * * *